US006332638B1

(12) United States Patent
Menna

(10) Patent No.: US 6,332,638 B1
(45) Date of Patent: Dec. 25, 2001

(54) APPARATUS FOR LOADING STRETCHERS ONTO AMBULANCES

(75) Inventor: Ezio Menna, Sala Baganza (IT)

(73) Assignee: Stem S.R.L., Langhirano (IT)

( * ) Notice: Subject to any disclaimer, the term of this patent is extended or adjusted under 35 U.S.C. 154(b) by 0 days.

(21) Appl. No.: 09/518,089

(22) Filed: Mar. 3, 2000

(30) Foreign Application Priority Data

Mar. 5, 1999 (IT) ..... RE990011 U

(51) Int. Cl.[7] ..... A61G 3/06; A61G 3/00
(52) U.S. Cl. ..... 296/20; 296/26.1; 5/626
(58) Field of Search ..... 296/20, 19, 18, 296/26.08, 26.09, 26.1; 5/626

(56) References Cited

U.S. PATENT DOCUMENTS 3,831,996 * 8/1974 Layer ..... 296/19
4,783,109 * 11/1988 Bucalo ..... 296/20
4,921,295 * 5/1990 Stollenwerk ..... 296/20
5,015,024 * 5/1991 Bloemer ..... 296/20
5,738,306 * 4/1998 Moss et al. ..... 296/20 X
5,785,277 * 7/1998 Manning et al. ..... 296/20 X
6,125,485 * 10/2000 Way et al. ..... 296/20 X

FOREIGN PATENT DOCUMENTS

3613376 * 4/1987 (DE) ..... 296/20
2558056 * 7/1985 (FR) ..... 296/20

* cited by examiner

*Primary Examiner*—Joseph D. Pape
*Assistant Examiner*—Patricia L. Engle

(57) ABSTRACT

An apparatus for loading stretchers into an ambulance which includes a loading table for the front end of the stretcher bed portion and by which the stretcher is transferred into the ambulance transporting compartment the loading table being positioned with its rear edge in a position projecting outwards from the rear surface of the ambulance; an auxiliary device applied to the rear edge of the loading table having a transverse horizontal abutment element which is positioned at a height lower than the rear end of the upper surface of the loading table in order to engage the front legs of the stretcher, starting from their erect position.

5 Claims, 7 Drawing Sheets

APPARATUS FOR LOADING STRETCHERS ONTO AMBULANCES

The present invention relates to an apparatus for loading stretchers onto ambulances.

Stretchers with foldable legs are known, having an overall flat upper portion in the form of a bed to support a person in a supine position, and rearward-foldable legs for resting on the ground in order to support said bed portion in a position raised from the ground to a height of between 50 and 90 cm.

To facilitate the loading of the stretcher into the transporting compartment of the ambulance, an apparatus is positioned within the ambulance transporting compartment and comprises an extractable loading table to be arranged with its rear edge projecting beyond the rear surface of the ambulance, at a height lower than the floor of the transporting compartment. The front end (provided for this purpose with wheels) of the bed portion of the stretcher is then slid onto the loading table, the rear end being gripped by an operator who pushes the stretcher forwards until it has been transferred into the ambulance transporting compartment.

The stretcher legs are connected to the bed portion in such a manner that on pushing the stretcher towards the ambulance, the front end of the bed portion first rests on the rear edge of the loading table, then as the stretcher is further pushed its front end slides along the loading table whereas its legs strike the rear edge of the loading table to rotate rearwards and upwards until they assume their folded position completely adhering to the bed portion.

This operation is carried out manually, typically by a single operator who supports the rear edge of the stretcher while at the same time pushing the stretcher forwards.

The legs fold rearwards by overcoming the reaction forces which tend to maintain the legs in the stable vertical position. This folding position consequently requires considerable force on the part of the operator.

An object of the present invention is to facilitate the operation of loading the stretcher along the loading table by easing that stage during which the stretcher legs are folded rearwards by the thrust exerted by the operator.

SUMMARY OF THE PRESENT INVENTION

The present invention utilizes an auxiliary device applied to the rear edge of the extractable loading table and includes a transverse horizontal abutment element which is positioned at a height lower than the rear end of the upper surface of the loading table in order to engage the stretcher legs.

BRIEF DESCRIPTION OF THE DRAWINGS

The present invention is described in detail hereinafter with the aid of the accompanying figures, which illustrate one embodiment thereof by way of non-limiting example.

DETAILED DESCRIPTION OF THE INVENTION

Figure 1A:
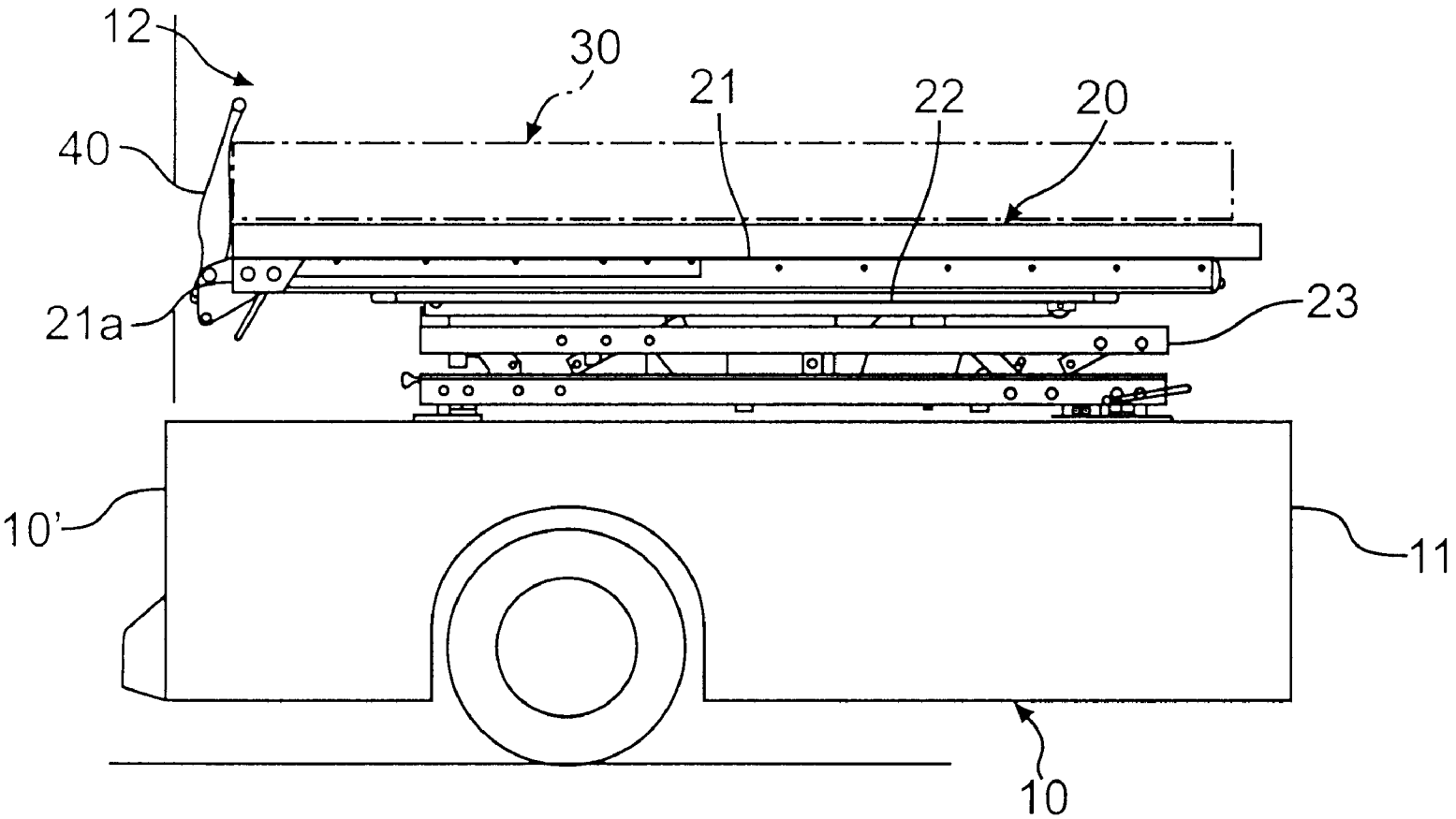
FIG. 1A is a side view of the stretcher loading apparatus in its completely retracted configuration, assumed during ambulance travel.
Figure 1B:
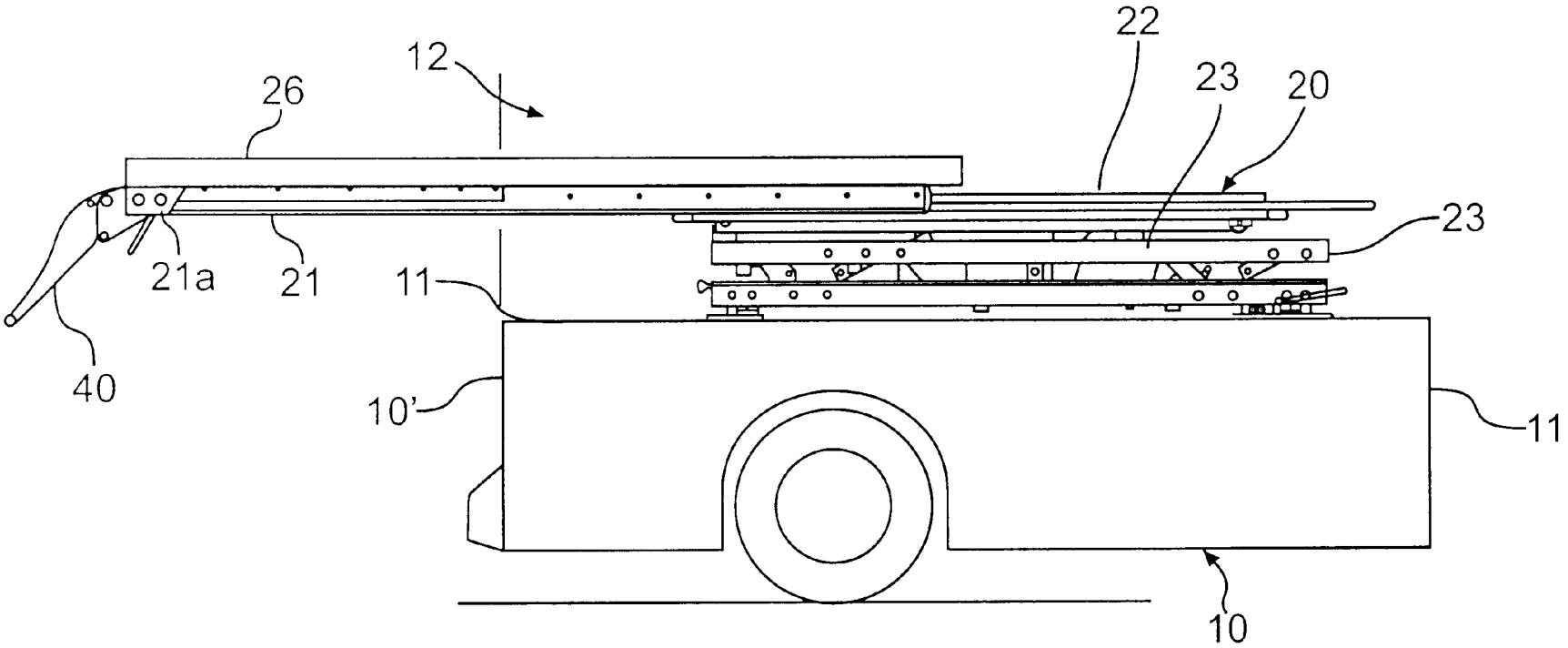
FIG. 1B is a view similar to FIG. 1A, with the loading apparatus in its completely withdrawn but horizontal configuration.
Figure 1C:
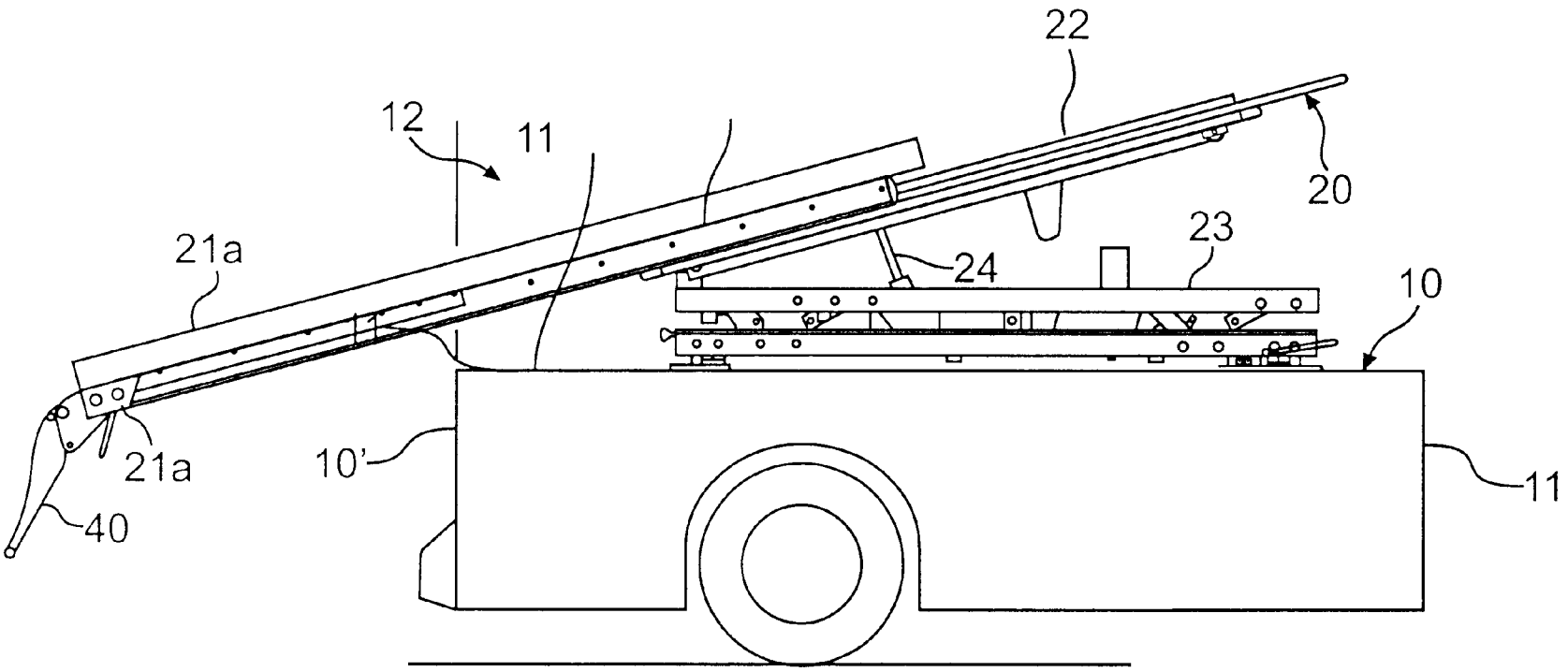
FIG. 1C is a view similar to FIG. 1A, with the loading apparatus in its completely withdrawn but inclined configuration, suitable for loading a stretcher.

FIGS. 1A, 1B, 1C show schematically the rear portion of an ambulance (indicated overall by 10) having a floor 11 positioned in a transporting compartment 12 and on which a stretcher loading apparatus 20 is mounted.

The apparatus 20 is of known type and comprises an extractable loading table 21 having an elongate flat upper surface 25 to receive the rested stretcher in a folded position. Along the longitudinal central line of the surface 25 there is positioned a rail 26 acting as a guide for the stretcher which slides along it and also enabling the stretcher to be locked when completely loaded onto the loading table 21.

In the embodiment shown in the figures, the apparatus 20 is secured to an upper frame 22 carried by a lower frame 23 fixed to the floor 11, the entire assembly being arranged such that the loading table 21 can assume various positions, to facilitate the loading of the stretcher. When the ambulance is moving, the apparatus 20 is maintained in its retracted configuration in which it lies horizontally on the frame 22 and lies totally within the interior of the transporting compartment 12 (as shown in FIG. 1A). The loading table 21 is connected telescopically to the frame 22 so that it can be withdrawn horizontally, for example by being pulled by hand, in a rearward direction (as shown in FIG. 1B). In addition, the upper frame 22 is connected to the lower frame 23 in such a manner as to enable it to be swivelled, in particular by the operation of a hydraulic cylinder-piston unit 24.

To load a stretcher, the loading table 21 is first pulled rearwards to withdraw it from the upper frame 22 (FIG. 1B), then the frame 22 is inclined (FIG. 1C) to move the rear edge 21*a* of the loading table 21 into a position in which it projects outwards from the rear surface 10' of the ambulance to a height lower than the floor 11 of the transporting compartment.

The loading apparatus 20 operates in combination with a stretcher 30 having a substantially flat, horizontal bed portion 31 able to support a person in the supine position, and containing rearward-foldable legs 32*a* and 32*b* for resting on the ground in order to support the bed portion in a position raised from the ground to a height exceeding at least 50 cm. The bed portion 31 comprises a horizontal flat frame 34 provided with idle wheels 33 positioned close to the front end 31*a* to slide along the loading table 21.

Two front legs 32*a* and two rear legs 32*b* are hinged to the frame 34 and pivoted at their lower end to a horizontal lower frame 35 provided with idle wheels 36 by which the stretcher is moved along the ground.

The hinging system for the front legs 32*a* is such that their upper ends 321 are connected to the frame 34 of the bed portion 31 by connections which enable them to swivel and to slide in a longitudinal direction along the frame 34. Connection bars 322 are also provided having their upper end pivoted to the frame 34 in front of the legs 32*a* and their lower end pivoted to an intermediate point on the legs 32*a*.

The hinging system for the rear legs 32*b* is similar to that of the front legs, their upper ends 323 being connected to the frame 34 by connections which enable them to swivel and to slide in a longitudinal direction along the frame 34. Connection bars 324 are also provided having their upper end pivoted to the frame 34 in front of the legs 32*b* and their lower end pivoted to an intermediate point on the legs 32*b*.

By virtue of the described hinging systems, together with other means (of known type, not shown in the figures) for locking and releasing the positions of the upper ends of the legs, when the stretcher 30 is to be moved along a flat surface it is locked in its erect configuration, in which the legs 32*a* and 32*b* are positioned virtually vertically and stably, and the stretcher is moved via the lower wheels 36 which roll on the ground. To enable the stretcher to be transported by the ambulance inside the compartment 12, the hinging system for the legs 32*a* and 32*b* is released and the legs are folded rearwards flat, together with the lower frame 35, against the frame 34 (retracted configuration, shown in FIG. 4B).

The stretcher 30 possesses reaction means, for example of spring type (of known type, not shown in the figures), which tend to maintain the legs 32*a* and 32*b* in their erect position. To fold the legs (which occurs while the stretcher is being loaded onto the ambulance), these reaction means, which are of considerable force, must be overcome at least through a certain angle (20–40 degrees).

As is well known, to be loaded into the ambulance compartment 12, the stretcher 30 is pushed from behind towards the ambulance rear surface 10' until the wheels 33 located at the front end of the bed portion 31 have been positioned on the rear edge 21*a* of the loading table 21. Then the operator grips the rear end of the bed portion 31 and pushes the stretcher forwards so that the wheels 33 slide along the surface 25 of the loading table 21. During this stage the hinging systems for the legs 32*a* and 32*b* release to enable the legs to rotate in order to fold rearwards, until they close into the retracted position.

A rod 37 having an arc-shaped configuration with its convex rear facing frontwards is fixed to each front leg 32*a*.

According to the present invention, to the rear edge 21*a* of the loading table 21 there is applied an auxiliary device 40 having a transverse horizontal abutment element 41 positioned at a height lower than the rear end 25*a* of the upper surface 25 of the loading table in order to strike the front legs 32*a* of the stretcher, while in their erect position.

The auxiliary device 40 comprises at least one support element 42, and in this particular case two, the upper end of which is pivoted by a transverse horizontal pin 43 to the rear edge 21*a* of the loading table 21, their lower end being rigidly joined to the abutment element 41.

In detail, the pin 43 is fixed at its ends to two brackets 44 fixed to the rear edge 21*a* of the loading table, to the sides of the device 40.

The profile of the upper surface 42' of the elements is inclined rearwards and downwards overall. In particular, the upper surface 42' has a S-configures profile which extends in a continuous manner from the upper surface 25 of the rear end of the loading table 21 to the abutment element 41 thereby providing initially a higher loading speed and a lower ending loading speed thereby avoiding shock to the stretcher 30.

The upper end of the surface 42' is positioned close to the rear end 25*a* of the surface 25, the profile of the upper portion 421 of the surface 42' being arched with its convexity facing rearwards, to blend into the upper surface 25 of the loading table as a continuation of it, without or almost without discontinuity.

The profile of the lower portion 422 of the surface 42' forms a rearward-facing concavity in proximity to the abutment element 41.

By virtue of the pin 43, the auxiliary device 40 can be moved into two stable positions, namely a first position, operative for loading the stretcher, in which the abutment element 41 is positioned withdrawn from and lower than the rear end 25*a* of the surface 25, and a second position, suitable for transporting the stretcher when placed on the apparatus 20, in which the device 40 is rotated upwards above the upper surface 25 of the loading table.

Figure 2B:
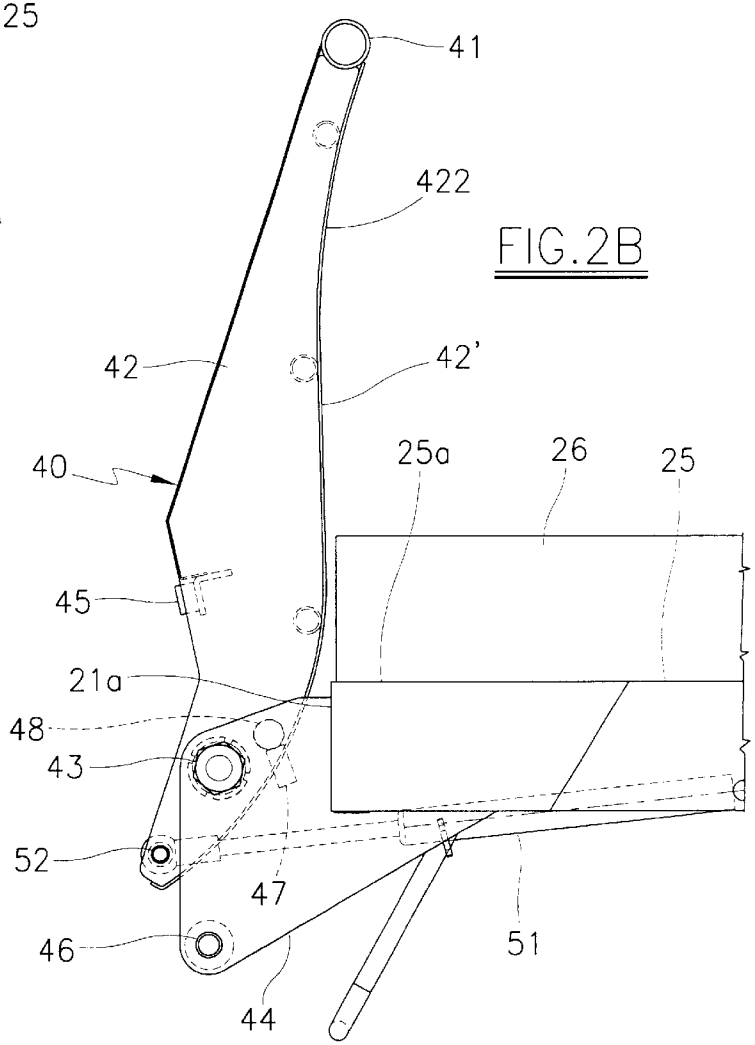
FIG. 2B is a view similar to FIG. 2A, with the auxiliary device in the ambulance travel configuration.
Figure 2A:
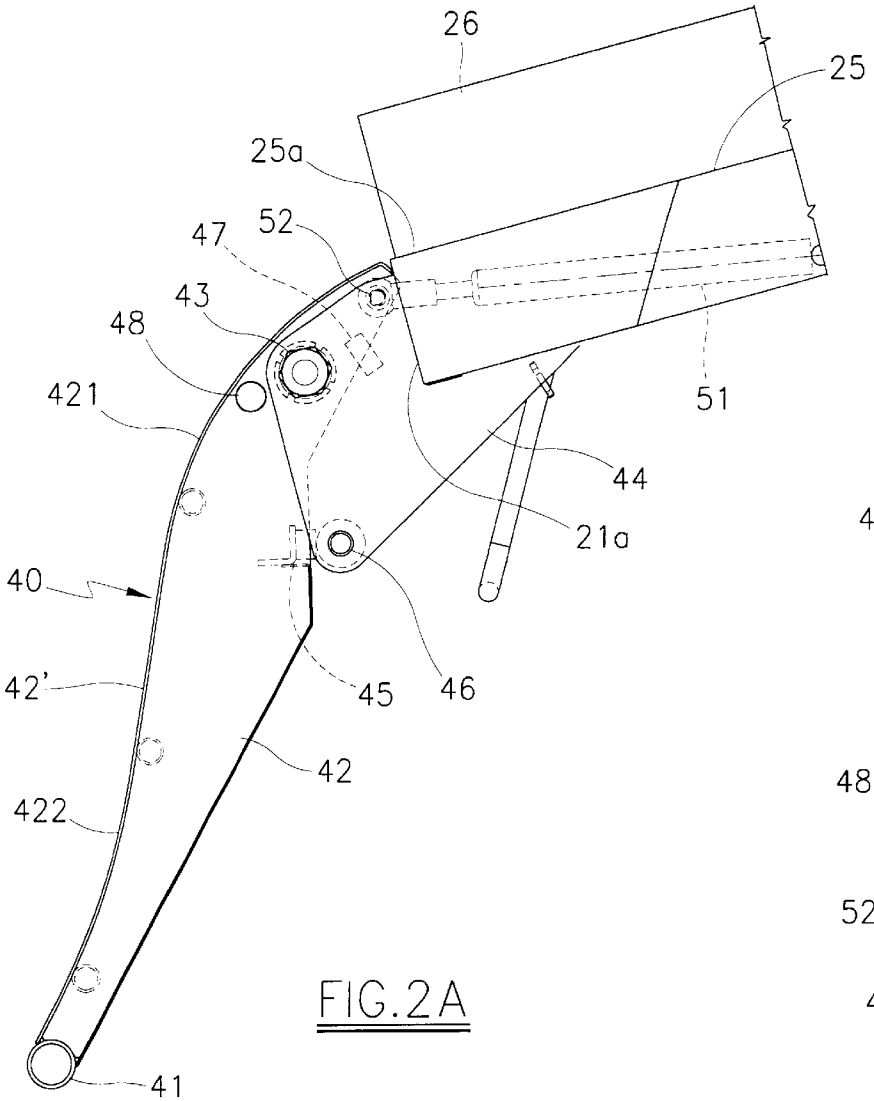
FIG. 2A is an enlarged detail of FIG. 1C, showing the auxiliary device of the invention in the stretcher loading configuration.
Figure 3:
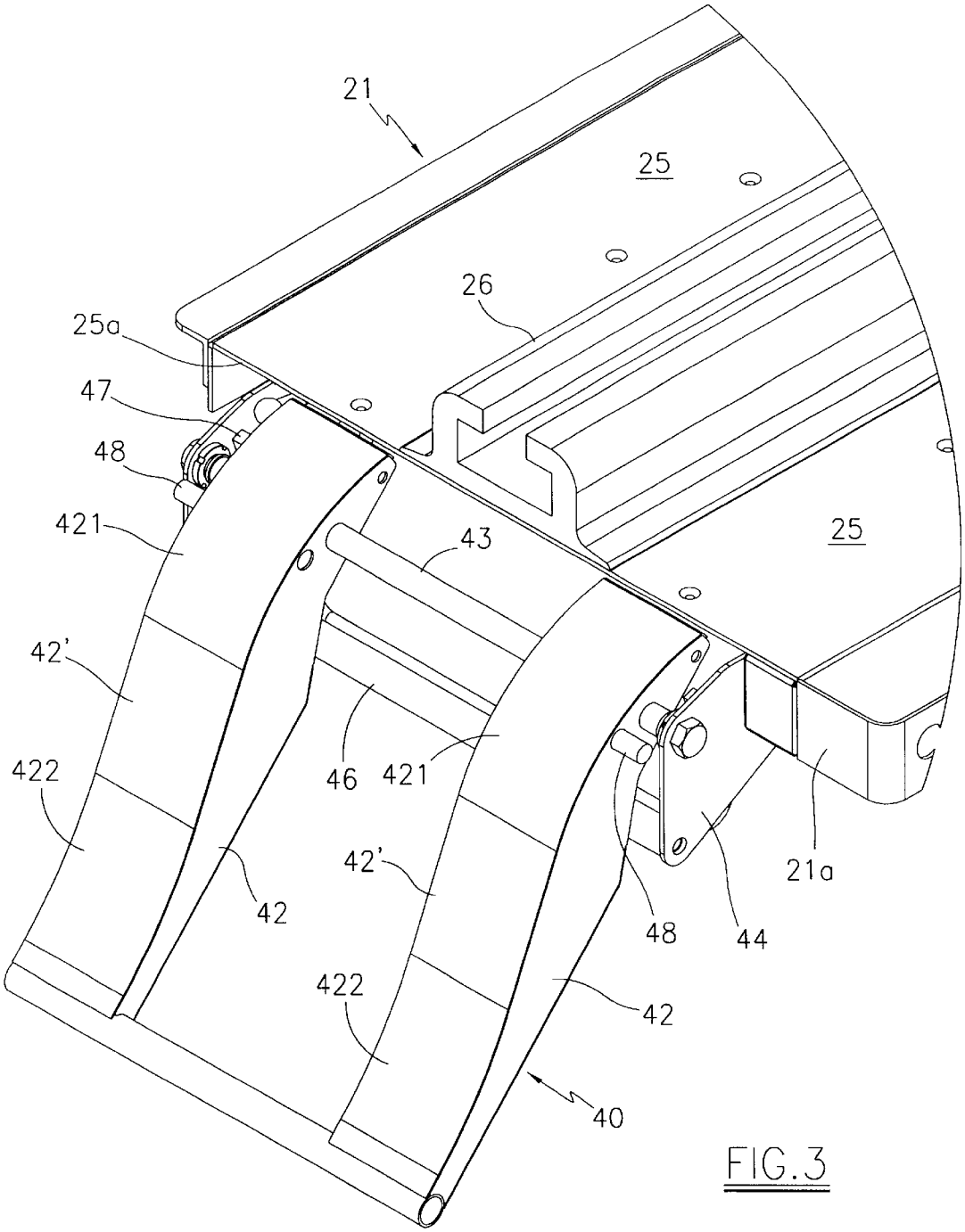
FIG. 3 is a perspective view of FIG. 2A.

The downward rotation of the device 40 is limited by a transverse bar 46 positioned to the rear of the elements 42 and fixed to the brackets 44, and against which the support elements 42 rest via contact elements 45 fixed to the elements 42, to provide the first operative position (see FIG. 2A).

The upward rotation of the device 40 is limited by stops 47 fixed to the brackets 44, and against which the elements 42 rest via contact pins 48 fixed to the elements 42, to define the second position (see FIG. 2B).

A precompressed spring reaction device 51 is provided having one end hinged at 52 to the upper end of one of the elements 42, and its other end hinged to the loading table 21 at a height substantially equal to that of the pin 43. The precompressed spring reaction device 51 acts with a rearwardly directed force and is in such geometrical relationship with the position of the hinge point 52 that when the device 40 is in the first position it is urged to rotate anticlockwise (in accordance with FIG. 2A) such that the elements 45 are thrust against the bar 46, hence making this position stable. When the device 40 is in the second position, the means 51 urges it to rotate clockwise (in accordance with FIG. 2B) such that the pins 48 are thrust against the stops 47, hence also making this position stable.

In the embodiment shown in the figures, the abutment element 41 is defined by a bar of circular cross-section. This element 41 is located in a position which, in the vertical direction, lies 30–60 cm from the rear end 25*a* of the upper surface 25 of the loading table, and in the horizontal direction, projects outwards from said rear end 25*a* by 20–40 cm.

Figure 4A:
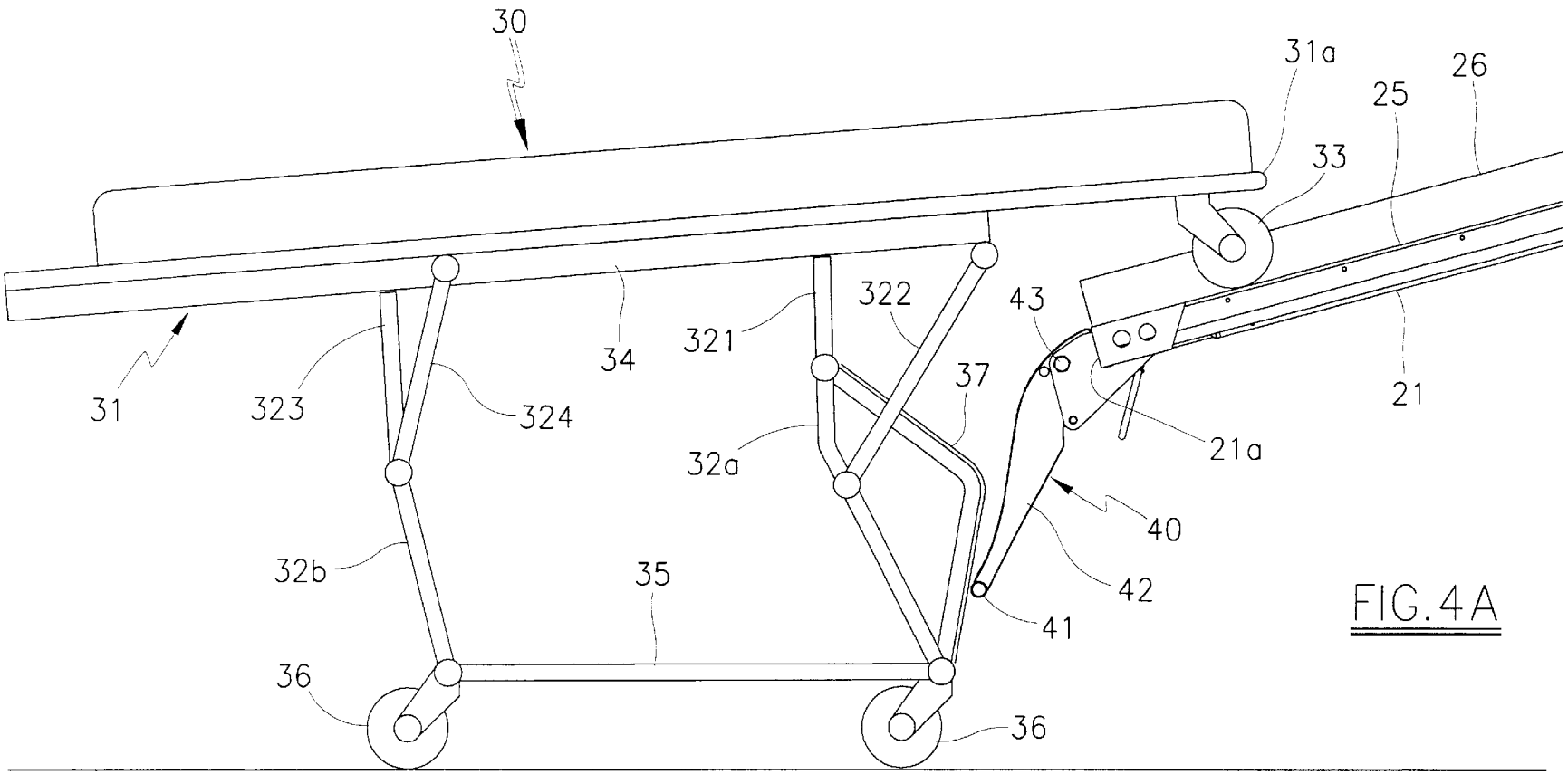
FIG. 4A shows the rear portion of the apparatus of FIG. 1C in the initial stage of the stretcher loading operation.
Figure 4B:
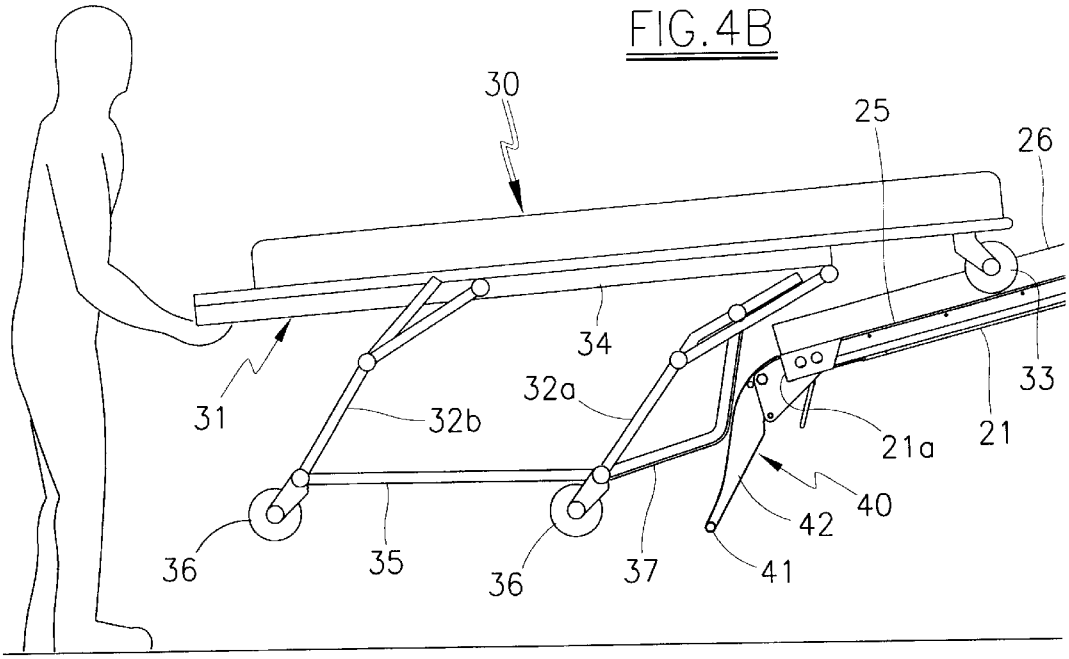
FIG. 4B and FIG. 4C are views similar to FIG. 4A, showing respective stages following the stretcher loading operation.
Figure 4C:
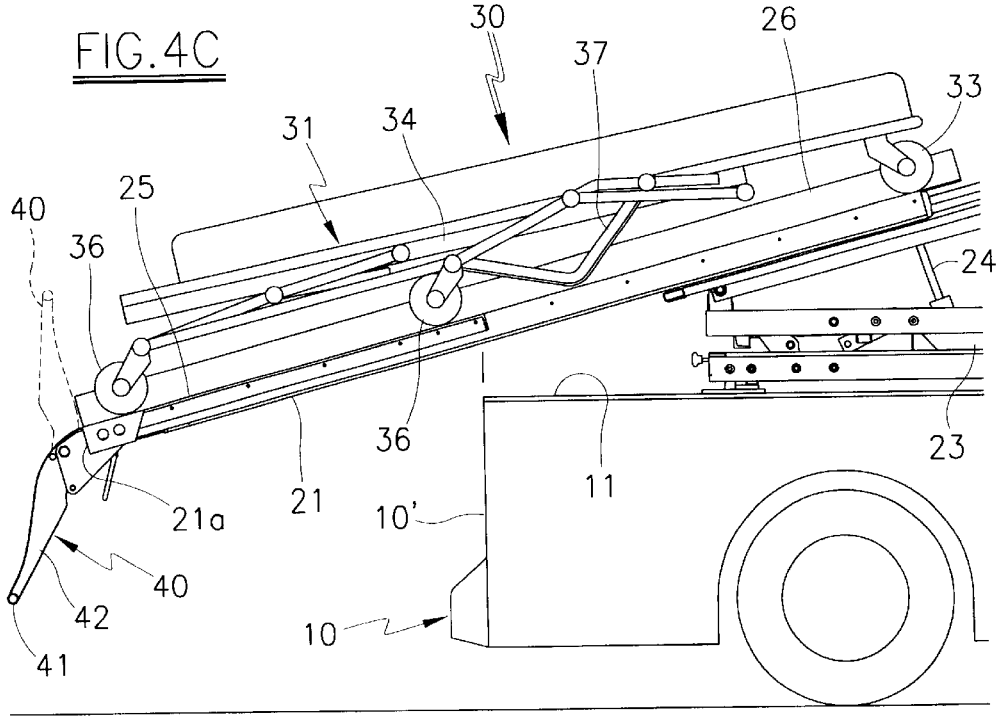

During use, when pushing the stretcher towards the ambulance compartment 12, the front wheels 33 reach the rear end 25*a* of the surface 25, and the element 41 more or less simultaneously abuts against the rods 37 of the front legs 32*a* to halt their travel (see FIG. 4A). Consequently as the operator continues to push the stretcher forwards, the front end of the bed portion advances along the surface 25, whereas the front legs 32*a* (and with them the rear legs 32*b*) are folded rearwards by the stop action provided by the abutment element 41 or by the elements 42 (as shown in FIG. 4B), to overcome the resistance offered by the reaction means which tend to maintain the legs 32*a* and 32*b* in their erect position, until they are completely folded into their retracted position (as shown in FIG. 4C).

As the point in which the legs 32*b* come into contact with the abutment element 41 is in a relatively low position (in any event lower than the point at which contact with the rear edge 21*a* would occur if the auxiliary device 40 were not provided), and hence the distance between this point of contact and the hinge system for the legs 32*a* is relatively large, the horizontal force with which the operator has to push the stretcher to overcome the moment of the resistive force caused by the reaction means is relatively small.

The particular concave profile of the lower portion 422 of the surface 42' of the elements 42 is such that contact with the bent rods 37, at least through a certain angle (of 20–40 degrees) starting from their erect position, takes place at the element 41 and hence in the lowest possible position.

Having overcome this angle, the reaction means no longer offers a high resistance, or indeed actually facilitate the folding of the legs.

When the legs 32*a* and 32*b* have assumed a completely retracted position, the stretcher 30 is totally loaded onto the loading table 21, at which point the device 40 can be manually rotated upwards into its second position. The loading table 21 is then raised into a horizontal position (by the cylinder-piston unit 24) and is finally pushed forwards into the transporting compartment 12, until the configuration shown in FIG. 1A is attained.

What is claimed is:

1. An apparatus for loading a stretcher having rearward foldable legs into an ambulance, which comprises a loading table for receiving the front end of the stretcher for transferring the stretcher into the ambulance when said loading table is positioned with its rear edge projecting outwards from the rear surface of the ambulance, an auxiliary device pivotably connected to the rear edge of the loading table and terminating at its free end as a transverse horizontal abutment element which is positioned at a height lower than the rear end of the upper surface of the loading table at least one support element having its upper end secured to the rear edge of the loading table and its lower end joined to the abutment element, said support element having a S-configured profile which extends in a continuous manner from the upper surface of the rear end of the loading table to the abutment element thereby providing initially a higher loading speed and a lower ending loading speed thereby avoiding shock to the stretcher.

2. The loading apparatus as claimed in claim 1, wherein the auxiliary device comprises at least one support element having its upper end secured to the rear edge of the loading table and its lower end joined to the abutment element, the profile of the upper surface of the support element being overall inclined rearwards and downwards in said S-configured profile.

3. The loading apparatus as claimed in claim 1, wherein the S-configured profile of the upper portion of the support element of the surface is arched with its convexity facing rearwards, to blend into the upper surface of the loading table as a continuation thereof without any discontinuity.

4. The loading apparatus as claimed in claim 1, wherein the S-configured profile of the upper surface of the support element forms a rearward-facing concavity in proximity to the abutment element.

5. The loading apparatus as claimed in claim 1, wherein the auxiliary device is hinged at its upper end to the rear edge of the loading table such as to be able to be moved into a first position, operative for loading the stretcher, in which the abutment element is in a position withdrawn from and lower than the rear edge of the loading table, and a second position, suitable for transporting the stretcher when placed on the apparatus, in which the device is rotated upwards above the upper surface of the loading table.

* * * * *